US009469455B2

(12) United States Patent
Clough

(10) Patent No.: US 9,469,455 B2
(45) Date of Patent: Oct. 18, 2016

(54) DISCREET DUAL PACKAGING

(75) Inventor: Jane Louise Clough, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1948 days.

(21) Appl. No.: 12/607,445

(22) Filed: Oct. 28, 2009

(65) Prior Publication Data

US 2011/0095021 A1 Apr. 28, 2011

(51) Int. Cl.
*B65D 75/56* (2006.01)

(52) U.S. Cl.
CPC ..... *B65D 75/56* (2013.01)

(58) Field of Classification Search
CPC ..... B65D 75/56
USPC ..... 220/23.83, 752, 754, 756, 757, 758
See application file for complete search history.

(56) References Cited

U.S. PATENT DOCUMENTS

| | | | | | |
|---|---|---|---|---|---|
| 276,171 | A | * | 4/1883 | Fraser | 229/120.09 |
| 1,863,190 | A | * | 6/1932 | Coulapides | 206/256 |
| 1,866,323 | A | * | 7/1932 | Russell | 206/750 |
| 2,046,484 | A | * | 7/1936 | Ringler | 206/256 |
| 2,353,761 | A | * | 7/1944 | Ringler | 229/101 |
| 2,873,058 | A | * | 2/1959 | Janson | 229/120.09 |
| 2,931,491 | A | * | 4/1960 | Taylor | 206/431 |
| 2,955,739 | A | * | 10/1960 | Collura | 229/117.13 |
| 3,226,010 | A | * | 12/1965 | Rogers, Jr. | 229/87.13 |
| 3,482,867 | A | * | 12/1969 | Allen | 294/28 |
| 3,656,614 | A | * | 4/1972 | Jacobson | 206/431 |
| 4,294,353 | A | * | 10/1981 | Focke et al. | 206/273 |
| 4,377,237 | A | * | 3/1983 | Pawlowski | 229/120.18 |
| 4,385,690 | A | * | 5/1983 | Olsen | 206/150 |
| 4,396,128 | A | * | 8/1983 | Larson et al. | 215/399 |
| 4,550,439 | A | * | 10/1985 | Peppiatt et al. | 383/28 |
| 4,582,199 | A | * | 4/1986 | Schuster | 206/428 |
| 4,932,534 | A | * | 6/1990 | Focke et al. | 229/120.011 |
| 4,986,420 | A | * | 1/1991 | Gunn et al. | 229/117.22 |
| 5,044,494 | A | * | 9/1991 | Tamura | 206/299 |
| 5,048,687 | A | * | 9/1991 | Suzuki et al. | 206/497 |
| 5,054,619 | A | * | 10/1991 | Muckenfuhs | 206/494 |
| 5,160,767 | A | * | 11/1992 | Genske et al. | 428/35.9 |
| 5,174,443 | A | * | 12/1992 | Chance et al. | 206/256 |
| 5,180,056 | A | * | 1/1993 | Adams et al. | 206/256 |
| 5,209,394 | A | * | 5/1993 | Griffiths et al. | 229/225 |
| 5,261,533 | A | * | 11/1993 | Adams et al. | 206/261 |
| 5,277,359 | A | * | 1/1994 | Lindsay | 229/117.22 |
| 5,344,008 | A | * | 9/1994 | DeBlasio et al. | 206/256 |
| 5,361,905 | A | * | 11/1994 | McQueeny et al. | 206/494 |
| 5,400,494 | A | * | 3/1995 | Stilley | 29/434 |
| 5,417,365 | A | * | 5/1995 | Lindsay | 229/117.22 |

(Continued)

FOREIGN PATENT DOCUMENTS

| | | |
|---|---|---|
| EP | 0 454 541 A1 | 10/1991 |
| JP | 11-147516 A | 6/1999 |

(Continued)

*Primary Examiner* — Stephen Castellano
(74) *Attorney, Agent, or Firm* — Kimberly-Clark Worldwide, Inc.

(57) ABSTRACT

A package includes a first compartment joined to a second compartment by a hinge. A handle bridges the hinge and is connected with the first compartment and the second compartment. The package has a display condition wherein the brand faces are exposed and a transport condition wherein the brand faces are concealed. The handle and hinge are configured such that the package is transformed from the display condition to the transport condition by applying force to the handle.

13 Claims, 6 Drawing Sheets

(56) References Cited

U.S. PATENT DOCUMENTS

| | | | | |
|---|---|---|---|---|
| 5,967,319 | A * | 10/1999 | White, Jr. | 206/428 |
| 6,578,724 | B1 * | 6/2003 | Owens | 220/23.6 |
| 7,055,876 | B2 | 6/2006 | Woldekidan | |
| 7,155,882 | B2 * | 1/2007 | Ghini et al. | 53/444 |
| 7,159,717 | B2 * | 1/2007 | Aldridge et al. | 206/449 |
| 7,347,033 | B2 * | 3/2008 | Gamberini et al. | 53/444 |
| 7,373,765 | B2 * | 5/2008 | Welchel et al. | 53/492 |
| 7,621,397 | B2 * | 11/2009 | Boudrie et al. | 206/391 |
| 7,721,887 | B2 * | 5/2010 | Hancock-Cooke et al. | 206/391 |
| 7,845,494 | B2 * | 12/2010 | Cerveny et al. | 206/432 |
| 7,913,846 | B2 * | 3/2011 | Aldridge et al. | 206/449 |
| 8,074,429 | B2 * | 12/2011 | Hodges et al. | 53/444 |
| 2004/0164575 | A1 * | 8/2004 | Francario | 294/156 |
| 2005/0150788 | A1 * | 7/2005 | Feusner | 206/278 |
| 2005/0194413 | A1 * | 9/2005 | Baker | 224/153 |
| 2006/0196797 | A1 | 9/2006 | Motsch et al. | |
| 2007/0141208 | A1 * | 6/2007 | Nukuto et al. | 426/129 |

FOREIGN PATENT DOCUMENTS

| | | | |
|---|---|---|---|
| WO | WO 94/00362 | A1 | 1/1994 |
| WO | WO 2006/050748 | A1 | 5/2006 |
| WO | WO 2006/131279 | A1 | 12/2006 |
| WO | WO 2009/013165 | A1 | 1/2009 |

* cited by examiner

DISCREET DUAL PACKAGING

BACKGROUND OF THE INVENTION

Many consumable products, such as paper towels, bath tissue, diapers and related products, adult incontinence products, child training pants, feminine hygiene products, and the like are sometimes packaged and sold in relatively large quantities. There are many advantages to consumers for purchasing these types of products in greater amounts. For instance, these types of products are typically consumed rather quickly and having greater amounts reduces the need to return to the store. Another advantage to consumers when buying in relatively large quantities is that the price per unit is typically less than when buying in smaller quantities.

There are also various advantages to manufacturers in the ability to sell their products to consumers in relatively large quantities. In particular, there may be some cost and processing efficiencies in packaging the products into larger packages. Shipping and handling costs may also be reduced.

When sold in bulk, consumable products are typically packaged in large rectangular plastic film bags or are sold in cardboard boxes. Due to the size of these packages, however, the packages can be somewhat difficult for consumers to carry and hold. Also, such large packages may also prominently indicate the contents of the products contained therein. This can cause embarrassment to some consumers who may not wish for others to know they are purchasing adult incontinence articles or feminine care articles for example. As such, a need currently exists for a package that is easy and intuitive to grasp and automatically orients the package such that it is less bulky and more discrete during transport.

SUMMARY OF THE INVENTION

In one aspect, the present invention provides a package having a first compartment defining a first compartment space and a second compartment defining a second compartment space. The package includes a hinge joining the first compartment to the second compartment and a handle bridging the hinge. The handle has a first point of connection with the first compartment and a second point of connection with the second compartment.

In various embodiments, each compartment has a front wall opposing a back wall; a top wall opposing a bottom wall; and a first side wall opposing a second side wall. The top wall, the bottom wall, the first side wall, the second side wall, the front wall, and the back wall of each compartment are joined together to define the first compartment space and the second compartment space respectively.

In various embodiments, the first compartment space may contain a plurality of first absorbent articles and the second compartment space may contain a plurality of second absorbent articles.

In some embodiments, the first point of connection and the second point of connection may be remote from the hinge. In some embodiments, the hinge may include a first line of weakness oriented such that breaking the first line of weakness completely separates the first compartment from the second compartment. In some embodiments, separating the first compartment from the second compartment at the first line of weakness preserves the first compartment space intact and the second compartment space intact.

In various embodiments, the handle may include a second line of weakness oriented such that breaking the second line of weakness completely separates a first portion of the handle having the first point of connection from a second portion of the handle which includes the second point of connection.

In some embodiments, the entire front wall of the first compartment defines a first front wall area and the entire front wall of the second compartment defines a second front wall area wherein the hinge is joined to and in facing relation with the front wall of the first compartment and is joined to and in facing relation with the front wall of the second compartment. The hinge may cover at least 50% of the front wall area and at least 50% of the second wall area.

In some embodiments, the hinge may be joined to the front wall of the first compartment with clean peel adhesive and the hinge may be joined to the front wall of the second compartment with clean peel adhesive.

In some embodiments, the hinge may include brand graphics and the front wall of the first compartment may not include any brand graphics and the front wall of the second compartment may not include any brand graphics.

In some embodiments, the front wall of the first compartment may include a first brand graphic visible through the hinge and the front wall of the second compartment may include a second brand graphic visible through the hinge.

In some embodiments, the front wall of the first compartment may include a first brand graphic visible through the handle and the front wall of the second compartment may include a second brand graphic visible through the handle.

In some embodiments, the hinge may include a brand graphic having a graphic area larger than either the first front wall area or the second front wall area.

In some embodiments, the hinge may include a first brand graphic and a second brand graphic and a line of weakness oriented between the first brand graphic and the second brand graphic, wherein breaking the first line of weakness completely separates the first compartment from the second compartment and completely separates the first brand graphic from the second brand graphic.

In another aspect, the present invention provides a package having a first compartment and a second compartment. Each compartment has a front wall opposing a back wall; a top wall opposing a bottom wall; and a first side wall opposing a second side wall. The top wall, the bottom wall, the first side wall, the second side wall, the front wall, and the back wall of each compartment are joined together to define a first compartment space and a second compartment space respectively. The first compartment space contains a plurality of first absorbent articles and the second compartment space contains a plurality of second absorbent articles. The package also includes a hinge joining the first compartment to the second compartment. The entire front wall of the first compartment defines a first front wall area and the entire front wall of the second compartment defines a second front wall area. The hinge is joined to and in facing relation with the front wall of the first compartment and joined to and in facing relation with the front wall of the second compartment. The hinge covers at least 50% of the front wall area and at least 50% of the second wall area. The package also includes a handle bridging the hinge and having a first point of connection with the first compartment and a second point of connection with the second compartment.

In various embodiments, the hinge may be joined to the front wall of the first compartment with clean peel adhesive and the hinge may be joined to the front wall of the second compartment with clean peel adhesive.

In some embodiments, the hinge may include brand graphics and the front wall of the first compartment and the front wall of the second compartment may not include any brand graphics.

In another aspect, the present invention provides a package having a first compartment joined to a second compartment by a hinge and a handle bridging the hinge and having a first point of connection with the first compartment and a second point of connection with the second compartment. The first compartment has a first primary brand face and the second compartment has a second primary brand face. The handle extends across a portion of the first primary brand face of the first compartment and across a portion of the second primary brand face of the second compartment. The package has a display condition wherein the primary brand face and the second primary brand face are exposed. The package has a transport condition wherein the first primary brand face and the second primary brand face are concealed. The handle and hinge are configured such that the package is transformed from the display condition to the transport condition by the single step of applying force to the handle.

In some embodiments, the first primary brand face and the second primary brand face may be visible through the handle in the display condition.

In some embodiments, the handle may include a grasping indicator.

DETAILED DESCRIPTION OF THE DRAWINGS

The present invention provides a package that is easy and intuitive to grasp and automatically places the package in an orientation such that it is less bulky and less awkward during transportation. The invention also provides a connection between dual packages such that the packages fold together in facing relation and conceal the branding during transportation.

Figure 1:
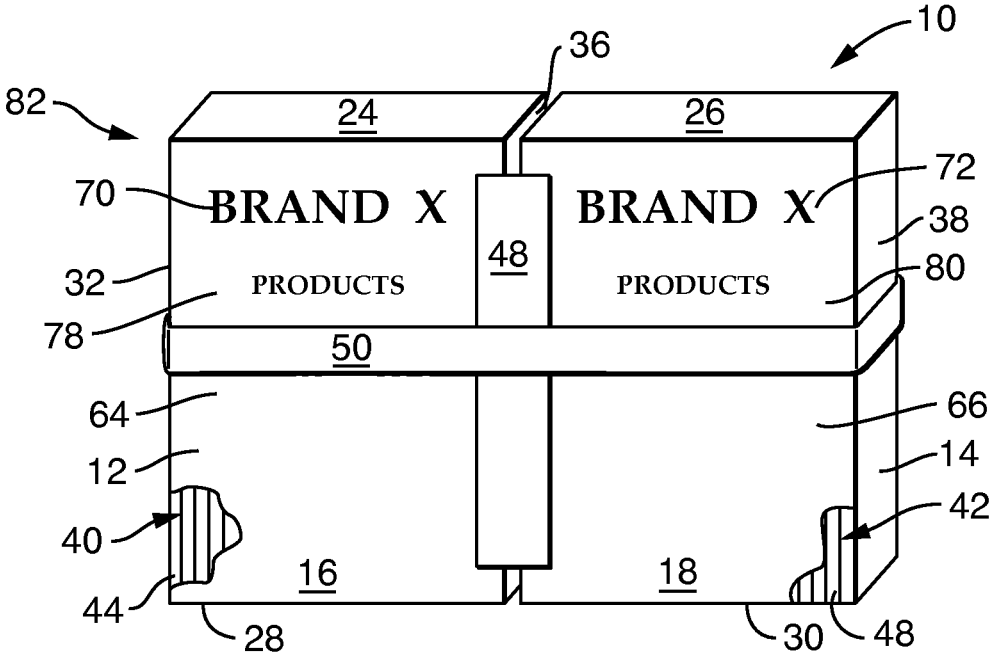
FIG. 1 representatively illustrates a front perspective view of a first exemplary package of the present invention.
Figure 2:
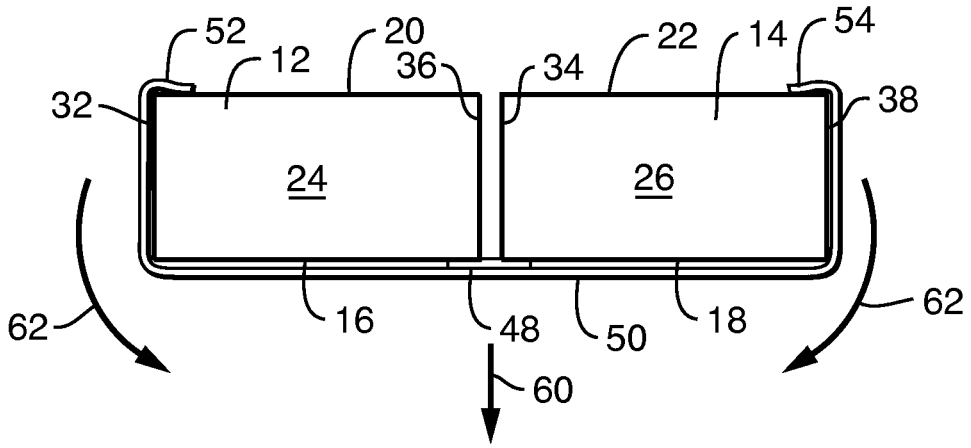
FIG. 2 representatively illustrates a top view of the package of FIG. 1.

Referring now to FIGS. 1 and 2, an exemplary embodiment is illustrated. Specifically, FIG. 1 representatively illustrates a front perspective view of a package 10 whereas FIG. 2 representatively illustrates a top view of the package 10 of FIG. 1. The package 10 includes a first compartment 12 and a second compartment 14. The first compartment 12 has a front wall 16 opposing a back wall 20; a top wall 24 opposing a bottom wall 28; a first side wall 32 opposing a second side wall 36, wherein the top wall 24, the bottom wall 28, the first side wall 32, the second side wall 36, the front wall 16, and the back wall 20 are joined together to define a fully contained first compartment space 40 containing a plurality of first articles 44. Likewise, the second compartment 14 has a front wall 18 opposing a back wall 22; a top wall 26 opposing a bottom wall 30; a first side wall 34 opposing a second side wall 38, wherein the top wall 26, the bottom wall 30, the first side wall 34, the second side wall 38, the front wall 18, and the back wall 22 are joined together to define a fully contained second compartment space 42 containing a plurality of second articles 46.

The first articles 44 and/or the second articles 46 may be any suitable packaged product such as, for example, absorbent articles, wipes, food, beverages, clothing, cosmetics, and the like. In various embodiments, the absorbent articles may include, for example, infant diapers, training pants, adult incontinence garments, feminine hygiene products, and the like. In some embodiments, the first articles 44 may be the same as the second articles 46. In other embodiments, the first articles 44 may be different than the second articles 46. For example, in one aspect, the first articles 44 and the second articles 46 may be adult incontinence articles. In another example, the first articles 44 may be feminine hygiene products such as tampons whereas the second articles 46 may be feminine hygiene products such as liners.

Referring again to the figures, the first compartment 12 and the second compartment 14 are illustrated herein as being substantially hexahedral. However, in various embodiments, the first compartment 12 and/or the second compartment 14 may have any suitable number of sides, shapes, and relative dimensions. In various embodiments, the first compartment 12 may have the same or different number of sides, shape, and/or relative size as compared to the second compartment 14. In some embodiments, the first compartment 12 and/or the second compartment 14 may also include gussets, flaps, seams, seals, and the like, and combinations thereof.

The package 10 also includes a hinge 48 joining the first compartment 12 to the second compartment 14. The package 10 also includes a handle 50. The handle 50 bridges the hinge 48 and has a first point of connection 52 with the first compartment 12 and a second point of connection 54 with the second compartment 14. The first point of connection 52 and/or the second point of connection 54 may be at any suitable location on the first compartment 12 and the second compartment 14 respectively. In some embodiments, as illustrated in FIGS. 1 and 2, the first point of connection 52 and the second point of connection 54 are remote from the hinge 48. As used herein, a point of connection is "remote" when directly joined to a wall other than the wall to which the hinge 48 is joined. In other words, the hinge 48 in FIGS. 1 and 2 is joined to the front wall 16 of the first compartment 12 and the front wall 18 of the second compartment 14 whereas the first point of connection 52 of the handle 50 is with the back wall 20 and the second point of connection 54 of the handle 50 is with the back wall 22. Thus, the points of connection in FIGS. 1 and 2 are remote from the hinge 48.

Figure 3:
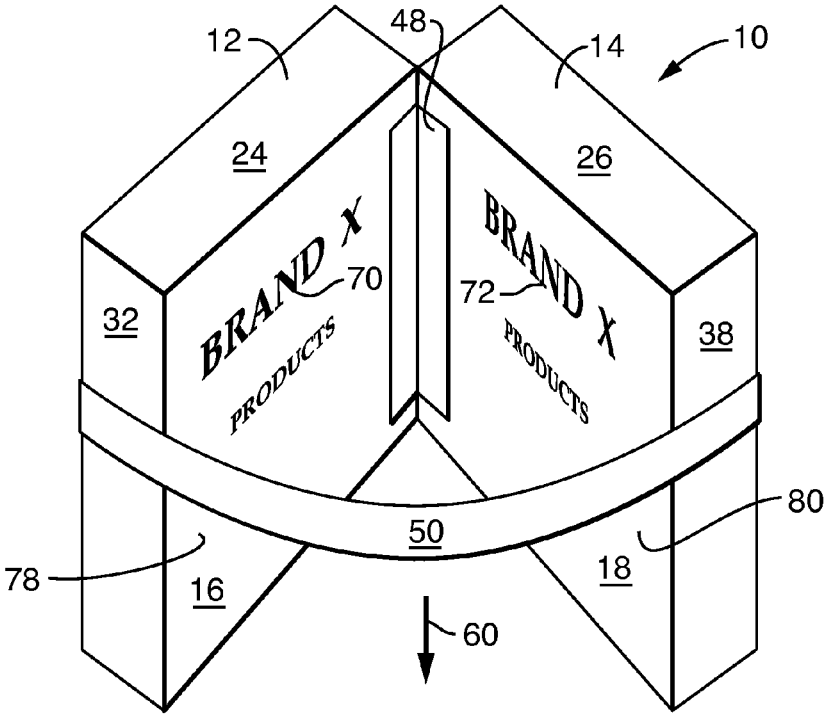
FIG. 3 representatively illustrates a front perspective view of the package of FIG. 1 as force is applied to the handle.
Figure 4:
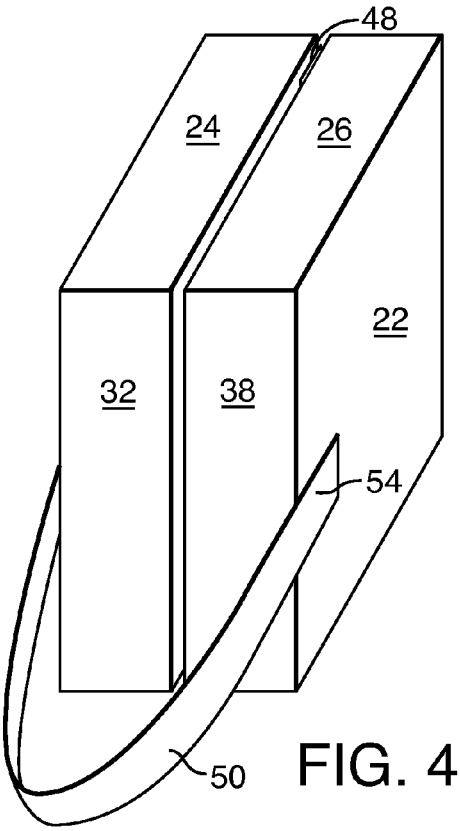
FIG. 4 representatively illustrates a perspective view of the package of FIG. 1 after force is applied to the handle.
Figure 5:
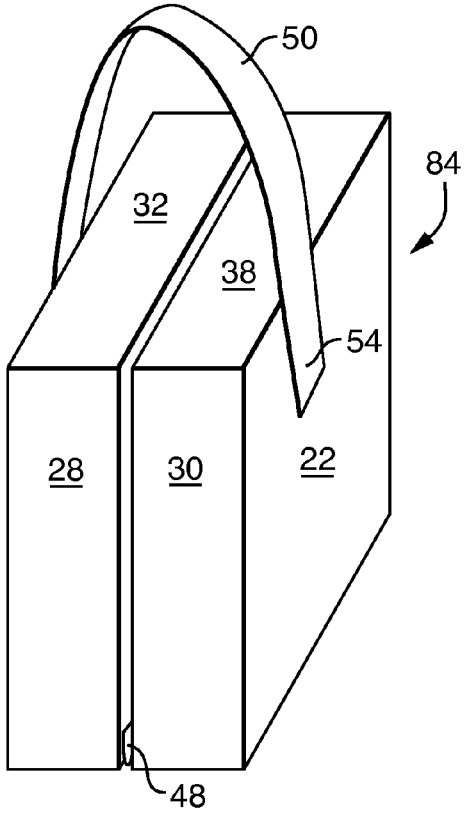
FIG. 5 representatively illustrates the package of FIG. 1 in the transport condition.

Referring now to FIGS. 2, 3, 4, and 5, an intuitive grasping system and automatic folding action are illustrated. FIG. 3 is a perspective view of the package 10 of FIG. 1 in a partially folded condition. FIG. 4 is a perspective view of the package 10 of FIG. 3 in a completely folded condition. FIG. 5 is a perspective view of the package 10 of FIG. 4 in a completely folded and upright condition suitable for carrying. The folding action is facilitated by the hinge 48 and the handle 50 being oriented such that application of a force to the handle 50 in a direction indicated by arrow 60 results in forces being applied to the first compartment 12 and the second compartment 14 via the first point of connection 52 and the second point of connection 54. Application of the force in the direction 60 results in movement in a direction indicated by arrows 62. As the force is continued in the direction 60, the package 10 begins to fold about the hinge 48 as illustrated in FIG. 3. As the package 10 is folding, front wall 16 of first compartment 12 is brought into facing relationship with front wall 18 of second compartment 14, as illustrated in FIG. 4, thereby concealing the front walls 16 and 18. Thus, with a single application of force in the direction 60 the package 10 is folded and ready to carry as illustrated in FIG. 5. In other words, only the force applied to the handle 50 is necessary to fold the package 10 as illustrated.

The hinge 48 may be any suitable size, shape, gauge or material that allows the first compartment 12 to be joined to and folded with the second compartment 14. For example, the hinge 48 may be made of polymer film, paper, paper board, cardboard, plastic, or the like, or combinations thereof. In various embodiments, the hinge 48 may be made of materials that are naturally flexible and easily foldable. In some embodiments, the hinge 48 may be made of materials that are less flexible but have been modified to promote folding at one or more desired locations. For example, the hinge 48 may be made of cardboard that has been scored, creased, compressed, or otherwise modified to promote folding at desired locations.

Figure 8:
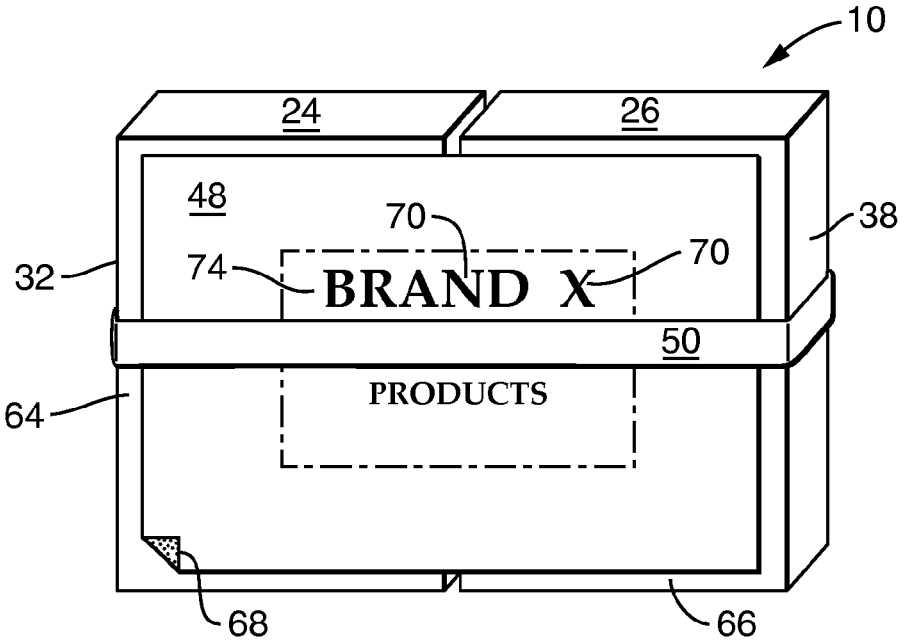
Figure 9:
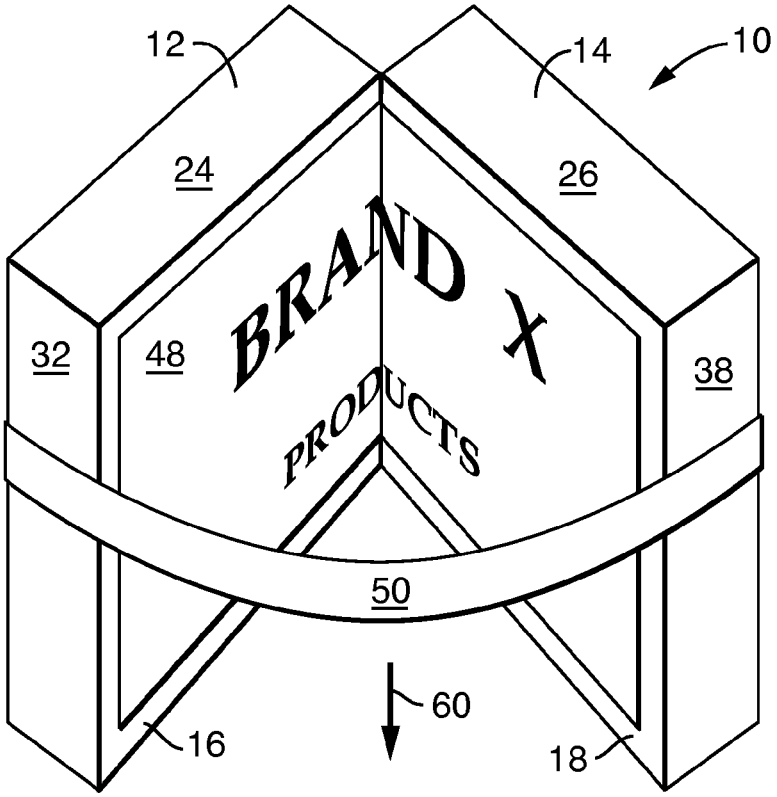
FIG. 9 representatively illustrates a front perspective view of the package of FIG. 8 as force is applied to the handle.

In various embodiments, the hinge 48 may be a relatively small sheet of material as illustrated in FIG. 1 or a relatively large sheet of material as illustrated in FIG. 8. The relative size of the hinge may be expressed as a percentage of area covered. Specifically, the entire front wall 16 of the first compartment 12 defines a first front wall area 64 and the entire front wall 18 of the second compartment 14 defines a second front wall area 66. In various embodiments, the hinge 48 may include one or more sheets of material joined to and in facing relation with the front wall 16 of the first compartment 12 and joined to and in facing relation with the front wall 18 of the second compartment 14. In various embodiments, the hinge 48 may cover at least 5%, at least 20%, at least 50%, at least 75%, or at least 95% of the first front wall area 64 and/or the second front wall area 66. As illustrated in FIG. 8, the hinge 48 includes a sheet of material covering at least 95% of the front wall area 64 and at least 95% of the second wall area 66. In comparison, FIG. 1 illustrates a hinge 48 that includes a sheet of material covering about 10% of the front wall area 64 and about 10% of the second wall area 66.

In some embodiments, the hinge 48 may be joined to the front wall 16 of the first compartment 12 by any suitable means. For example, the hinge 48 may be joined with the first compartment 12 and/or the second compartment 14 by adhesive, thermal bonding, ultrasonic bonding, pressure bonding, or the like, and combinations thereof. In some embodiments, the hinge 48 may be joined with the first compartment 12 and/or the second compartment 14 with adhesive 68 that allows the hinge 48 to be peeled from the first compartment 12 and/or the second compartment 14 without tearing, breaching, or otherwise damaging the first compartment 12 and/or the second compartment 14. In some embodiments, the adhesive 68 may be referred to as clean peel adhesive, dry peel adhesive, clear dry adhesive, dry release adhesive, dry separation adhesive, and the like. These adhesives may be polystyrene or polypropylene based adhesives and may be formulated for removal without leaving a residue.

Figure 6:
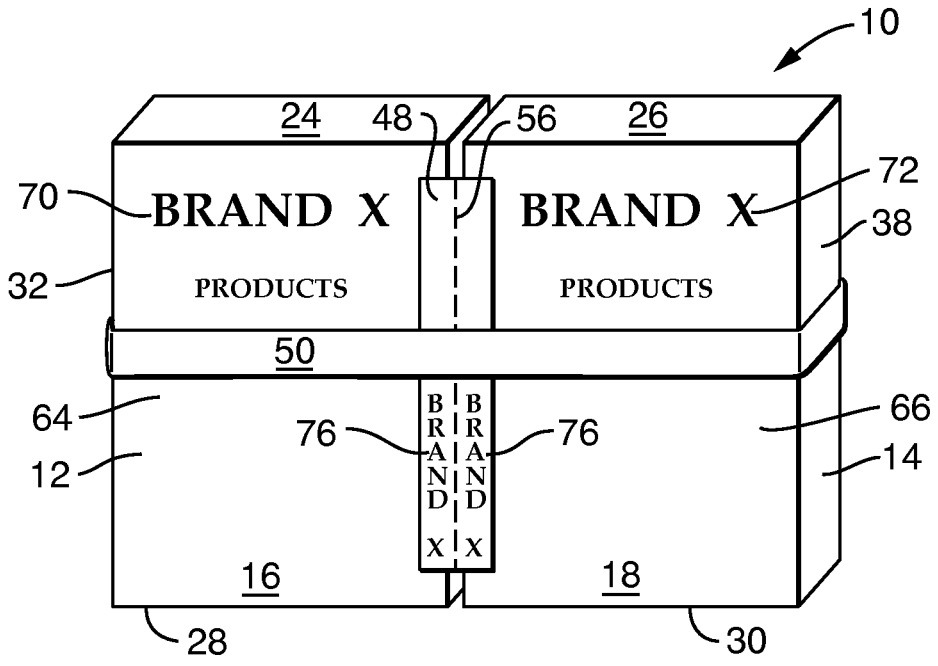
FIGS. 6-8 and 10-12 representatively illustrate a front perspective view of various exemplary packages of the present invention.

In some embodiments, the hinge 48 may include a first line of weakness 56 oriented such that breaking the first line of weakness 56 entirely separates the first compartment 12 from the second compartment 14 as illustrated in FIG. 6. In some embodiments, separating the first compartment 12 from the second compartment 14 at the first line of weakness 56 preserves the fully contained first compartment space 40 intact and/or the fully contained second compartment space 42 intact. For example, as illustrated in FIG. 6, separating the first compartment 12 from the second compartment 14 at the first line of weakness 56 does not affect or otherwise alter the first compartment space or the second compartment space.

The handle 50 may be made of any material suitable for connection with the compartments and/or hinge and suitable for transporting the package. For example, the handle 50 may be made from polymer film, paperboard, cardboard, rope, ribbon, metal, cloth, nonwoven materials, and the like, and combinations thereof. In some embodiments, the hinge may include a grasping indicator. The grasping indicator may include any suitable indicia for communicating the preferred grasping location and/or manner in which force is to be applied. For example, the grasping indicator may include words and/or symbols to draw a user's attention to the handle 50 in general or to specific portions of the handle 50. In some embodiments, the grasping indicator may include the words "pull here" printed on the center of the handle 50. Additionally, or alternatively, arrows or other indicia may be included on the handle 50 and/or compartments 12 and/or 14 to indicate the location and/or manner in which force is to be applied to the handle 50.

Figure 7:
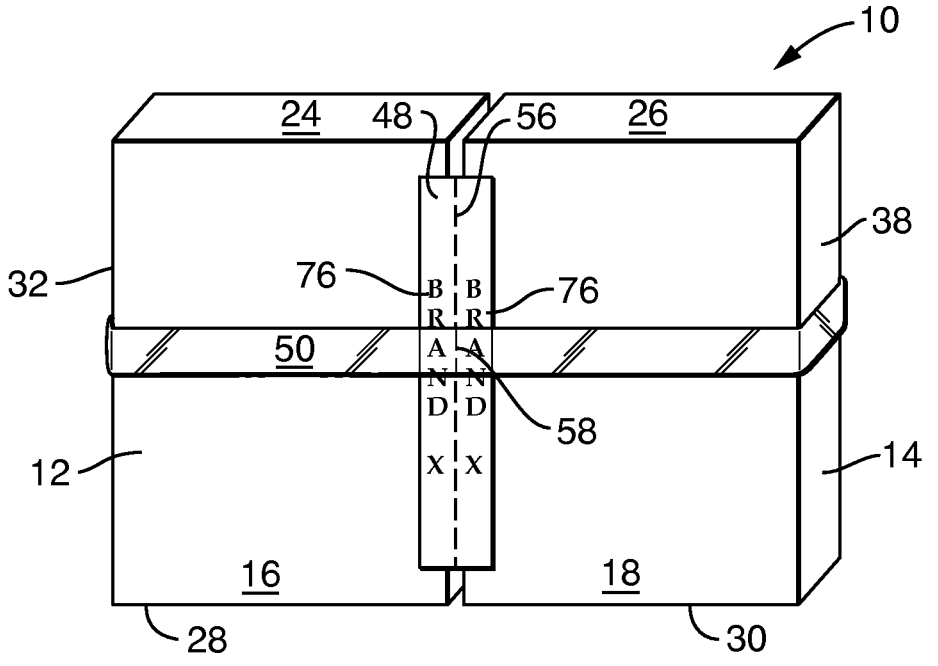

In some embodiments, the handle may include a second line of weakness 58. In various embodiments, the second line of weakness 58 may be oriented such that breaking the second line of weakness 58 allows complete separation of a first portion of the handle having the first point of connection with the first compartment from a second portion of the handle having the second point of connection with the second compartment. Referring now to FIG. 7, a package 10 is illustrated wherein the hinge 48 has a first line of weakness 56 and the handle 50 has a second line of weakness 58. In this embodiment, the first compartment 12 may be separated from the second compartment 14 while maintaining the first compartment space 40 intact and the second compartment space 42 intact. In these embodiments, a purchaser of the package 10 will be able to easily transport the package 10 in the store and will then be able to break the first line of weakness 56 and/or the second line of weakness 58 to separate the first compartment 12 from the second compartment 14 for ease of storage. In various embodiments, the first line of weakness 56 and/or the second line of weakness 58 may include any suitable means for weakening the material to promote separation proximate the lines of weakness. For example, the lines of weakness may include perforations, score lines, areas of decreased thickness, and the like, and combinations thereof.

Figure 11:
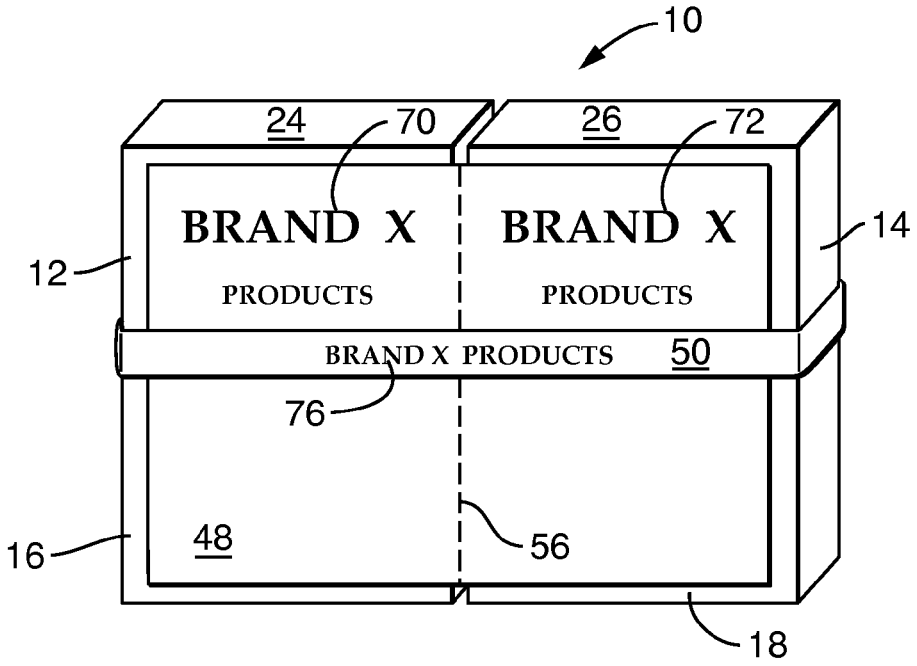

In various embodiments, the package 10 may include brand graphics. The brand graphics may be included on any combination of the walls 16-38 of compartments 12 and 14. For example, FIG. 1 illustrates a first brand graphic 70 on the front wall 16 of the first compartment 12 and a second brand graphic 72 on the front wall 18 of the second compartment 14. In various embodiments, the brand graphics may be included on the hinge 48. For example, FIG. 8 illustrates a first brand graphic 70 on the hinge 48. In some embodiments, the brand graphics may be only on the various walls 16-38 as illustrated in FIG. 1. In some embodiments, the brand graphics may be only on the hinge 48 as illustrated in FIG. 8. In some embodiments, the brand graphics may be on the walls and the hinge as illustrated in FIG. 6. In some embodiments, the brand graphics may additionally or alternatively be included on the handle as illustrated in FIG. 11.

In some embodiments, one or more of the walls of the first compartment may include a first brand graphic and/or one or more of the walls of the second compartment may include a second brand graphic and/or the hinge may include a third brand graphic wherein the first brand graphic and/or the second brand graphic and/or the third brand graphic is visible through the handle. For example, referring to FIG. 7, a package 10 is illustrated having a first compartment 12 and a second compartment 14. The package 10 also includes a hinge 48 joining the first compartment 12 to the second compartment 14 and a handle 50. The handle 50 bridges the hinge 48 and has a first point of connection with the first compartment 12 and a second point of connection with the second compartment 14. The hinge 48 includes brand graphics 76. The handle 50 is made of a material wherein the brand graphics 76 are visible through the handle material.

Figure 12:
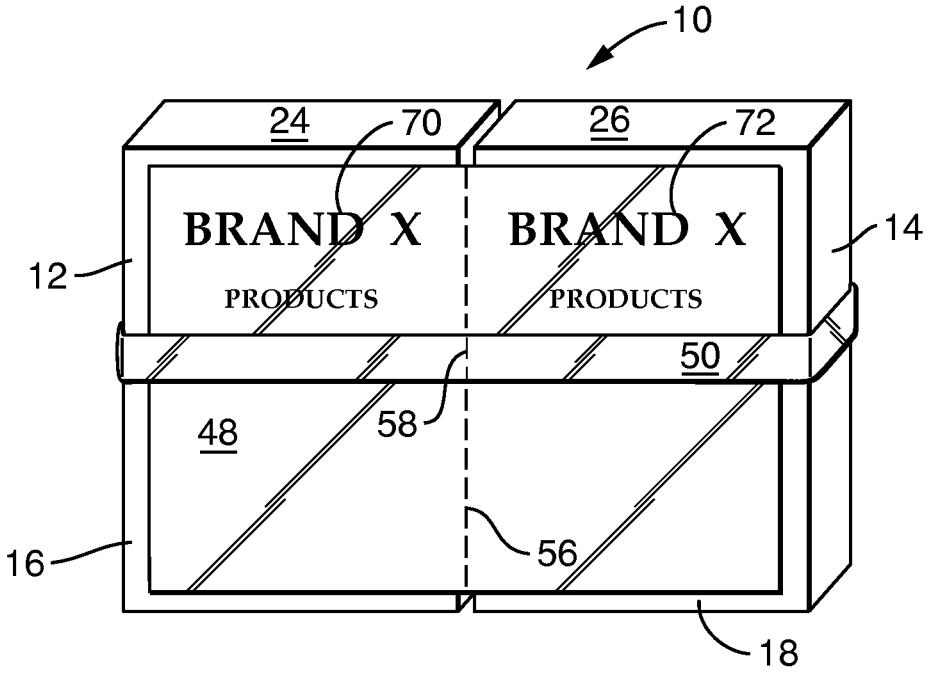

In some embodiments, the one or more of the walls of the first compartment may include a first brand graphic and/or one or more of the walls of the second compartment may include a second brand graphic wherein the first brand graphic and/or the second brand graphic is visible through the hinge. For example, referring to FIG. 12, a package 10 is illustrated having a first compartment 12, having a front wall 16 which in turn has a first brand graphic 70 thereon. Likewise, the package 10 also includes a second compartment 14, having a front wall 18 which in turn has a second brand graphic 72 thereon. The package 10 also includes a hinge 48 made of a sheet of material that is in facing relation with the front wall 16 of the first compartment 12 and at least partially covers the front wall 16. Additionally, the hinge material is in facing relation with the front wall 18 of the second compartment 14 and at least partially covers the front wall 18. The hinge 48 may be made of material such that the first brand graphic 70 and/or the second brand graphic 72 is visible through the hinge material.

Figure 10:
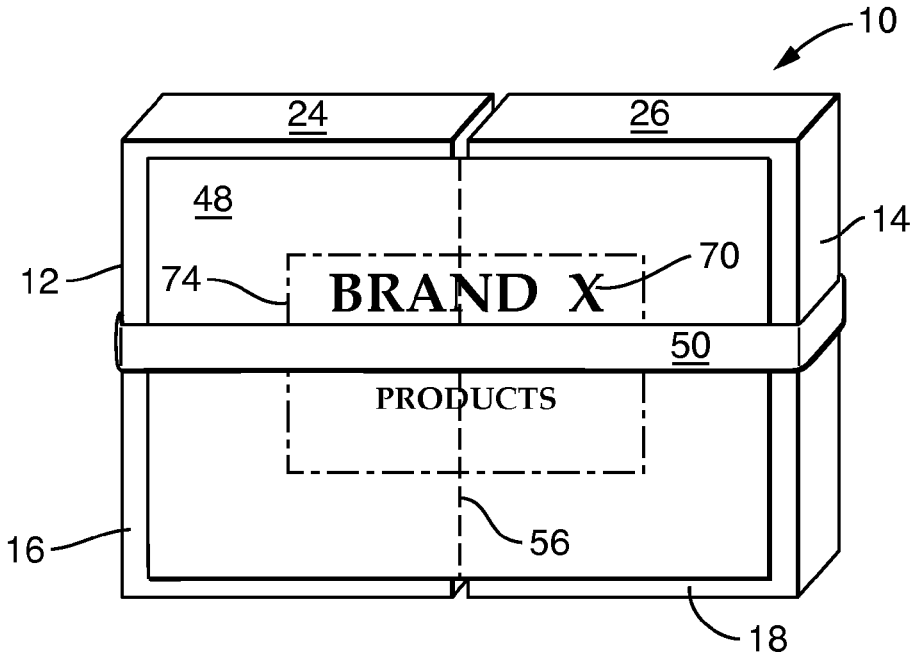

In some embodiments, the package may include a hinge having a brand graphic that is larger in area than the first front wall area and/or the second front wall area. For example, referring to FIGS. 8 and 10, a package 10 is illustrated having a first compartment 12 wherein the entire front wall 16 of the first compartment 12 defines a first front wall area 64. The package 10 also includes a second compartment 14 wherein the entire front wall 18 of the second compartment 14 defines a second front wall area 66. The package 10 also includes a hinge 48 having a brand graphic 70 that defines a brand graphic area 74 (illustrated as a dot-dash line) that is larger, in at least one dimension, than the first front wall area 64 and is larger, in at least one dimension, than the second front wall area 66. Thus, by including the hinge 48 of this embodiment, a larger brand graphic 70 is possible for maximum brand visibility on the shelf while folding into the carrying position to provide for minimum brand visibility during transportation of the package 10.

In some embodiments, the package may include a hinge having a first brand graphic, a second brand graphic, and a line of weakness separating the first brand graphic from the second brand graphic. For example, referring to FIG. 11, a package 10 is illustrated having a first compartment 12 and second compartment 14. The package 10 includes a hinge 48 joining the first compartment 12 to the second compartment 14. The hinge 48 also includes a first brand graphic 70, a second brand graphic 72, and a first line of weakness 56. The line of weakness 56 is oriented between the first brand graphic 70 and the second brand graphic 72 such that breaking the first line of weakness 56 completely separates the first compartment 12 from the second compartment 14 and completely separates the first brand graphic 70 from the second brand graphic 72.

Referring again to FIGS. 1-5, the present invention provides a package 10 that includes a first compartment 12 joined to a second compartment 14 by a hinge 48. The package 10 also includes a handle 50 bridging the hinge 48 and having a first point of connection 52 with the first compartment 12 and a second point of connection 54 with the second compartment 14. The first compartment 12 has a first primary brand face 78 and the second compartment 14 has a second primary brand face 80. The first primary brand face 78 and/or the second primary brand face 80 includes a first brand graphic 70 and/or a second brand graphic 72. The first primary brand face 78 and the second primary brand face 80 are adapted to be oriented towards the consumer when the product is positioned on a shelf in a retail setting. The handle 50 extends across a portion of the first primary brand face 78 of the first compartment 12 and the handle 50 extends across a portion of the second primary brand face 80 of the second compartment 14.

The package 10 has a display condition 82, as illustrated in FIG. 1, wherein the first primary brand face 78 of the first compartment 12 and the second primary brand face 80 of the second compartment 14 are visibly displayed. The package 10 also includes a transport condition 84, as illustrated in FIGS. 4 and 5, wherein the first primary brand face 78 of the first compartment 12 and the second primary brand face 80 of the second compartment 14 are concealed. The handle 50 and the hinge 48 are configured such that application of force to the handle 50 in the direction 60 transforms the package 10 from the display condition 82 to the transport condition 84. Thus, the relative combination of handle 50, hinge 48, and primary brand faces 78 and 80 allows the consumer to easily locate and identify the package 10 on the shelf by brand and then intuitively grasp the package 10 and easily transition the package 10 from the display condition 82 to the transport condition 84 wherein the brand is discreetly concealed between the first compartment 12 and the second compartment 14.

While the invention has been described in detail with respect to specific embodiments thereof, it will be appreciated that those skilled in the art, upon attaining understanding of the foregoing, will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A package comprising a first compartment joined to a second compartment by a hinge, a handle bridging the hinge and having a first point of connection with the first compartment and a second point of connection with the second compartment, the first compartment having a first primary brand face and the second compartment having a second primary brand face, the package having a display condition wherein the first primary brand face and the second primary brand face are exposed and substantially coplanar and wherein the handle extends across a portion of the first primary brand face of the first compartment and the second primary brand face of the second compartment and the package having a transport condition wherein the first primary brand face and the second primary brand face are concealed, wherein the handle and hinge are configured such that the package is transformed from the display condition to the transport condition by applying force to the handle.

2. The package of claim 1 wherein the first primary brand face and the second primary brand face are visible through the handle in the display condition.

3. The package of claim 1 wherein the handle includes a grasping indicator.

4. A package comprising, a first compartment and a second compartment, each compartment having a front wall opposing a back wall; a top wall opposing a bottom wall; a first side wall opposing a second side wall, wherein the top wall, the bottom wall, the first side wall, the second side wall, the front wall, and the back wall of each compartment are joined together to define a first compartment space and a second compartment space respectively, wherein the first compartment space contains a plurality of first absorbent articles and the second compartment space contains a plurality of second absorbent articles, a hinge joining the first compartment to the second compartment, wherein the entire front wall of the first compartment defines a first front wall area and the entire front wall of the second compartment defines a second front wall area and wherein the hinge is joined to and in facing relation with the front wall of the first compartment and joined to and in facing relation with the front wall of the second compartment wherein the hinge covers at least 50% of the front wall area and at least 50% of the second wall area, and a handle bridging the hinge and having a first point of connection with the first compartment and a second point of connection with the second compartment, wherein the handle sequentially transects the front wall of the first compartment and the font wall of the second compartment.

5. The package of claim 4 wherein the hinge is joined to the front wall of the first compartment with clean peel adhesive and the hinge is joined to the front wall of the second compartment with clean peel adhesive.

6. The package of claim 5 wherein the hinge includes brand graphics and the front wall of the first compartment and the front wall of the second compartment do not include brand graphics.

7. A package comprising, a first compartment defining a first compartment space and a second compartment defining a second compartment space, the first compartment having a first primary brand face and the second compartment having a second primary brand face;

a hinge joining the first compartment to the second compartment, and a handle bridging the hinge and having a first point of connection with the first compartment and a second point of connection with the second compartment, wherein the first and second primary brand faces are substantially coplanar when the package is in a display condition, and wherein the first and second primary brand faces are substantially parallel when the package is in a transport condition, wherein each compartment has a front wall opposing a back wall; a top wall opposing a bottom wall; a first side wall opposing a second side wall, and wherein the top wall, the bottom wall, the first side wall, the second side wall, the front wall, and the back wall of each compartment are joined together to define the first compartment space and the second compartment space respectively; and wherein the entire front wall of the first compartment defines a first front wall area and the entire front wall of the second compartment defines a second front wall area and wherein the hinge is joined to and in facing relation with the front wall of the first compartment and joined to and in facing relation with the front wall of the second compartment wherein the hinge covers at least 50% of the front wall area and at least 50% of the second wall area.

8. The package of claim 7 wherein the hinge is joined to the front wall of the first compartment with clean peel adhesive and the hinge is joined to the front wall of the second compartment with clean peel adhesive.

9. The package of claim 8 wherein the hinge includes brand graphics and the front wall of the first compartment and the front wall of the second compartment do not include brand graphics.

10. The package of claim 7 wherein the front wall of the first compartment includes a first brand graphic visible through the hinge and the front wall of the second compartment includes a second brand graphic visible through the hinge.

11. The package of claim 7 wherein the front wall of the first compartment includes a first bland graphic visible through the handle and the front wall of the second compartment includes a second brand graphic visible through the handle.

12. The package of claim 7 wherein hinge includes a brand graphic having a graphic area larger than either the first front wall area or the second front wall area.

13. The package of claim 7 wherein the hinge includes a first brand graphic and a second brand graphic and a line of weakness oriented between the first brand graphic and the second brand graphic, wherein breaking the first line of weakness completely separates the first compartment from the second compartment and completely separates the first brand graphic from the second brand graphic.

* * * * *